United States Patent [19]

Thirumalachar et al.

[11] Patent Number: 4,929,341

[45] Date of Patent: May 29, 1990

[54] PROCESS AND SYSTEM FOR RECOVERING OIL FROM OIL BEARING SOIL SUCH AS SHALE AND TAR SANDS AND OIL PRODUCED BY SUCH PROCESS

[75] Inventors: M. Jeersannidhi Thirumalachar; M. Jeersannidhi Narasimhan, Jr., both of Walnut Creek, Calif.

[73] Assignee: Source Technology Earth Oils, Inc., Walnut Creek, Calif.

[21] Appl. No.: 856,811

[22] Filed: Apr. 28, 1986

Related U.S. Application Data

[63] Continuation-in-part of Ser. No. 633,942, Jul. 24, 1984, abandoned, which is a continuation of Ser. No. 416,507, Sep. 10, 1982, abandoned.

[51] Int. Cl.[5] ..... C10G 1/00

[52] U.S. Cl. ..... 208/390; 208/391

[58] Field of Search ..... 208/390, 391

[56] References Cited

U.S. PATENT DOCUMENTS

| | | | |
|---|---|---|---|
| 3,509,037 | 4/1970 | Tse | 208/390 |
| 4,217,202 | 8/1980 | Paraskos et al. | 208/390 |
| 4,250,016 | 2/1981 | Estes et al. | 208/390 |
| 4,491,512 | 1/1985 | Euker, Jr. | 208/390 |

FOREIGN PATENT DOCUMENTS

| | | | |
|---|---|---|---|
| 976901 | 10/1975 | Canada | 208/390 |
| 2051856 | 1/1981 | United Kingdom | 208/390 |

*Primary Examiner*—Asok Pal

*Attorney, Agent, or Firm*—Willian Brinks Olds Hofer Gilson & Lione

[57] ABSTRACT

Oil bearing soil is contacted in a contacting zone with a liquid medium comprising water and a lipophilic solvent which is miscible or soluble with water. The medium can include a yield improving agent comprising a water soluble acidic ionic salt or a water soluble ionic acid. The contacting produces an emulsion which comprises the oil from the oil bearing soil and the liquid medium. The inorganic portion of the soil is dispersed in the emulsion and it is separated from the emulsion by gravity or other suitable means. The emulsion is broken by an emulsion breaking agent into two phases. The two phases are allowed to separate into two layers. The first layer comprises the oil and minor amounts of the liquid medium. The second layer comprises the liquid medium and minor amounts of the oil. The first layer is then recovered. The medium from the second layer can be recycled into the contacting zone.

11 Claims, 3 Drawing Sheets

PROCESS AND SYSTEM FOR RECOVERING OIL FROM OIL BEARING SOIL SUCH AS SHALE AND TAR SANDS AND OIL PRODUCED BY SUCH PROCESS

CROSS-REFERENCE TO RELATED APPLICATIONS

This application is a continuation-in-part application of copending U.S. patent application Ser. No. 06/633,942, filed July 24, 1984, now abandoned, which is a continuation of U.S. patent application Ser. No. 06/416,507, filed September 10, 1982 by Mandayam J. Thirumalachar and Mandayam J. Narsimhan, Jr., now abandoned.

BACKGROUND OF THE INVENTION

This invention relates to processes and a systems for recovering oil from oil bearing soil such as oil shales and tar sands. In particular, it relates to recovering of such oil by processes that include contacting oil bearing soil with liquid mediums.

The world population, especially in the industrial countries, consumes enormous amounts of energy. For example, in 1978 an equivalent of about 13.4 billion barrels of fuel oil was consumed in the United States alone. About half of the amount of energy was actually supplied by petroleum products. As the traditional sources of oil are being exhausted in industrial countries and as the price of the oil continues to be at a relatively high level, there is a growing need for the development of alternate sources of oil.

A virtually inexhaustible source of oil is oil bearing soil such as oil shale and tar sands. Oil recovered from oil shale and tar sands by conventional processes, such as retorting, is not identical in composition to the conventional crude oil recovered from the ground and for many applications such oil has to be further treated by distillation, coking of residue and/or hydrogenation to achieve the required composition. As used herein "oil" means organic materials including primarily hydrocarbons recovered from the ground, and the term is meant to include conventional crude, processed oil as well as oil recovered from soil even if the composition, impurities and the API number of such oil are different from the conventional crude or from the conventional processed oil.

The deposits of both tar sands and oil shale have been found on all of the inhabited continents. Although at present the precise amounts of oil available in these deposits cannot be determined, it is estimated that they would yield some 2 quadrillion barrels of oil. The United States has large shale deposits in several regions. The deposits in the Green River formation in Colorado, Utah and Wyoming are of particular interest because they contain oil shale having the highest oil concentration of any oil shale in the world. One of the largest known deposits of tar sands extends for several thousand square miles in the Athabasca District of Alberta, Canada. Large oil shale or tar sand deposits have also been found in Australia, Brazil, Bulgaria, Burma, Congo, France, Germany, Great Britain, Italy, Israel, New Zealand, South Africa, Spain, Sweden, Switzerland, Thailand, U.S.S.R. and Yugoslavia.

Despite the fact that enormous amounts of oil are present in the oil shale and tar sand deposits and the fact that such deposits are located in many of the most technologically advanced countries (including the United States and Canada), the amounts of oil actually obtained from these deposits are insignificant in the total energy picture. The reason for is that oil is trapped in the oil shale and tar sands and is extremely difficult and expensive to recover. Specifically, in the oil shale, the organic fraction (called kerogen) is composed of carbon and hydrogen molecules cross-linked together by sulfur and oxygen atoms to form macromolecules with molecular weights of about 3000. These macromolecules are embedded within a matrix of inorganic or mineral materials. The problem in recovering oil from oil shale is that it is extremely difficult to separate kerogen from the inorganic matrix. Kerogen is insoluble in most standard petroleum solvents and has to be heated to relatively high temperatures in order to effect a separation. At a temperature of about 204° C. (400° F.) chemical bonds between and within the organic molecules break down and the smaller molecules formed as a result can be separated as a liquid or gaseous product from the inorganic matrix.

It is also difficult to separate and recover oil from tar sands because organic material is bound to and between interstices of sand. Thus, heat or special solvents are required to break the organic material away from the sand.

Most of the commercial operations for recovering oil from shale or tar sands have used the heating (retorting) method for separating the oil. In fact, the recovery of oil by heating oil shale or tar sands goes back some 150 years. The efforts to improve on the basic method have been expanded in a number of countries, spurred by the oil embargo and the significant rise in the price of oil. Despite the use of the finest technical talents and the expenditure of enormous amounts of money by giant industrial corporations, these efforts have been unsuccessful in devising a commercially successful process which can be used to make oil shale a significant contributor of world's energy requirements. Some of the retorting processes, developed thus far, are described in a report entitled "An Assessment Of Oil Shale Technology" published by The Congress of the United States, Office of Technology (1980), and in an article appearing in Chemical Engineering, September 7, 1981, pages 47–51, and 63–71. The magnitude of the efforts that went into the unsuccessful development of a commercially feasible and profitable process and system is illustrated by the withdrawal of Exxon Company, U.S.A. from the oil shale venture after spending millions of dollars.

The reason for the failures of the retorting processes is that they use enormous amounts of energy, require huge capital expenditures and produce by-products—spent shale or sand—which have to be treated in order to support vegetation. More specifically, enormous amounts of energy must be used to heat large amounts of oil bearing soil to the required retorting temperatures which generally range between about 500° C. (900° F.) and about 800° C. (1500° F.). Large capital expenditures are needed for building the equipment to effect heating of the oil bearing soil, even if the heating is done in situ. The spent (or processed) soil subjected to a retorting process generally has an alkaline pH. Processed shales retorted at temperatures of about 500° C. (900° F.) generally have pHs ranging from about 8 to 9 and those retorted at temperatures of 750° C. to 800° C. (1400° to 1500° F.) have pHs of 11 or 12. In order to use such spent shales as growth media for plants, their alkalinity must be reduced. The pH reductions can be achieved by adding acids or acid-formers to the shale; however, such treatment significantly raises the overall costs of the recovery process. Additionally, the spent shales have high concentrations of boron, molybdenum, selenium, arsenic and Fluorine which can be toxic to animals which feed on plants grown in such soil. The retorting processes also result in relatively low yields—30 to 40%—in part because heating shales to above about 500° C. transforms some of the organic materials into char.

Another approach to recovering oil from oil bearing soil including shale and tar sands has been to extract oil from oil bearing soil with solvents. For example, U.S. Pat. No. 4,242,195 (Rudnick) discloses extraction of organic constituents, such as hydrocarbons and phenols from tar sands and oil shales. The Rudnick patent discloses extraction using a solvent predominantly comprising certain organic sulfoxides, organic sulfones, or mixtures thereof. U.K. Patent No. 1,495,722 (Williams, et al.) discloses extracting oil from oil shale using a variety of organic solvents at elevated temperatures (80° C. to 550° C.) and at elevated pressures (500 to 10,000 psi). Recently, McKay et al. have proposed a process for recovery of organic components of oil shale which involves penetrating the shale with a methanol-water solution and then extracting the organic material by refluxing it with a benzene/methanol mixture. This experimental process is conducted at about 400° C. See "Nonretorting Method Recovers Shale Organics," Chemical & Engineering News September 14, 1981.

The proposed extraction processes have not been entirely successful because they employ organic solvents which are generally quite expensive. Additionally, many of the processes also require, for commercial production, high temperatures and high pressures. The use of high temperatures and/or pressures, in turn, necessitates sophisticated and expensive equipment.

There is, therefore, a long felt and unsatisfied need for a commercially viable process and system for recovering oil from oil bearing soil including oil shale and tar sands, which process does not suffer from the aforementioned disadvantages.

Thus, one object of the present invention is to provide a process for recovering oil from oil bearing soil including oil shale and tar sands, which is inexpensive and creates minimal pollution and disposal problems.

Another object of this invention is to provide a process for extracting oil from oil bearing soil including oil shale and tar sands that requires small capital expenditures and significantly less energy to operate than the retorting processes.

A further object of the present invention is to provide a process for recovering oil from oil bearing soil, such as oil shale or tar sands that does not require high temperatures and pressures for its operation.

Still another object of the present invention is to provide a process and a system for recovering oil from oil bearing soil, such as oil shale or tar sands, which utilizes a liquid medium that is inexpensive.

A still further object of the present invention is to provide a process for recovering oil from oil bearing soil, such as oil shale or tar sand, using a liquid medium which can be recycled.

Still another object of the present invention is to provide a process for the recovery of oil from oil bearing soil such as oil shale and tar sands, which produces a spent soil that does not impair vegetation and has a pH value close to neutral.

A still further object of the present invention is to provide a process for the recovery of oil from oil bearing soil, such as oil shale or tar sands, which uses an inexpensive and easily available medium composed primarily of water.

Still another object of the present invention is to provide a high-yield process for recovering oil from oil bearing soil such as oil shale or tar sands.

Other objects of the invention will become apparent to those skilled in the art upon studying this disclosure.

BRIEF DESCRIPTION OF THE INVENTION

In accordance with one aspect of the present invention, oil bearing soil, such as oil shale or tar sands, is contacted in a contacting zone with a liquid medium comprising water and a lipophilic solvent which is miscible or soluble with water. The contacting produces an emulsion which comprises the oil from the oil bearing soil and the liquid medium. The inorganic portion of the soil is dispersed in the emulsion and it is separated from the emulsion by gravity or other suitable means. The emulsion is then broken by an emulsion breaking agent into two phases. The two phases are allowed to separate into two layers. The first layer comprises the oil and some liquid medium. The second layer comprises the liquid medium and some oil. The first layer is then recovered. The medium from the second layer can be recycled into the contacting zone. In the alternative, the inorganic portion of the soil can be separated and removed after the emulsion is broken.

In accordance with another aspect of the present invention, oil bearing soil, such as oil shale or tar sands, is contacted in a contacting zone with a liquid medium comprising water, a lipophilic solvent which is miscible or soluble with water, and a yield improving agent comprising a soluble ionic salt or a soluble ionic acid. Unexpectedly superior results are obtained when isopropyl alcohol is used as the solvent especially with a yield improving agent. Unexpectedly good results are achieved when the yield improving agent is ammonium sulfate especially if the amount of ammonium sulfate is at or near the saturation point. Unexpectedly good results are also achieved when the solvent is acetone, and when the solvent is ethyl acetate and the yield improving agent is sulfuric acid.

The inorganic portion is separated from the emulsion. The emulsion is then broken by an emulsion breaking agent and the resulting two phases are allowed to separate from each other into two layers. If the yield improving agent is at or near the saturation point of the medium, the emulsion breaking agent can be additional solid ionic salt, preferably of the same type as the yield improving agent. The inorganic portion can also be separated after the emulsion is broken.

The first layer comprises the oil, minor amounts of the medium and minor amounts (if any) of the inorganic portion. The second layer comprises the medium, minor amounts of the oil and minor amounts (if any) of the inorganic portion. The first layer is then recovered and the second layer can be recycled to the contacting zone.

In accordance with a third aspect of the present invention, tar sand is contacted with successive liquid mediums. In the first step, tar sand is contacted in a first contacting zone with a first liquid medium comprising water, a solvent which is not miscible or appreciably soluble with water, a surfactant and a non-caustic alkali compound all intimately mixed to form a phase emulsion. The first liquid medium and bitumen released from the tar sand are separated from the sand, followed by separation of the bitumen and solvent from the aqueous portion of the separated liquid. The bitumen is recovered and the solvent may be recycled. The aqueous portion, containing the surfactant and non-caustic alkali compound, may also be recycled.

The sand left from treatment in the first contacting zone is treated in a second contacting zone with a second liquid medium comprising water, a surfactant and a non-caustic alkali compound. The second liquid medium and additional recovered bitumen are separated from the sand. The bitumen is recovered and the second liquid medium may be recycled. The resulting sand may be contacted again with the second liquid medium and this step of the process repeated one or more times, each time recovering the bitumen and, if desired, recycling the liquid medium.

Other aspects of the present invention will become apparent to those skilled in the art upon studying this specification and the appended claims.

DETAILED DESCRIPTION OF THE FIRST TWO ASPECTS OF THE INVENTION

Figure 1:
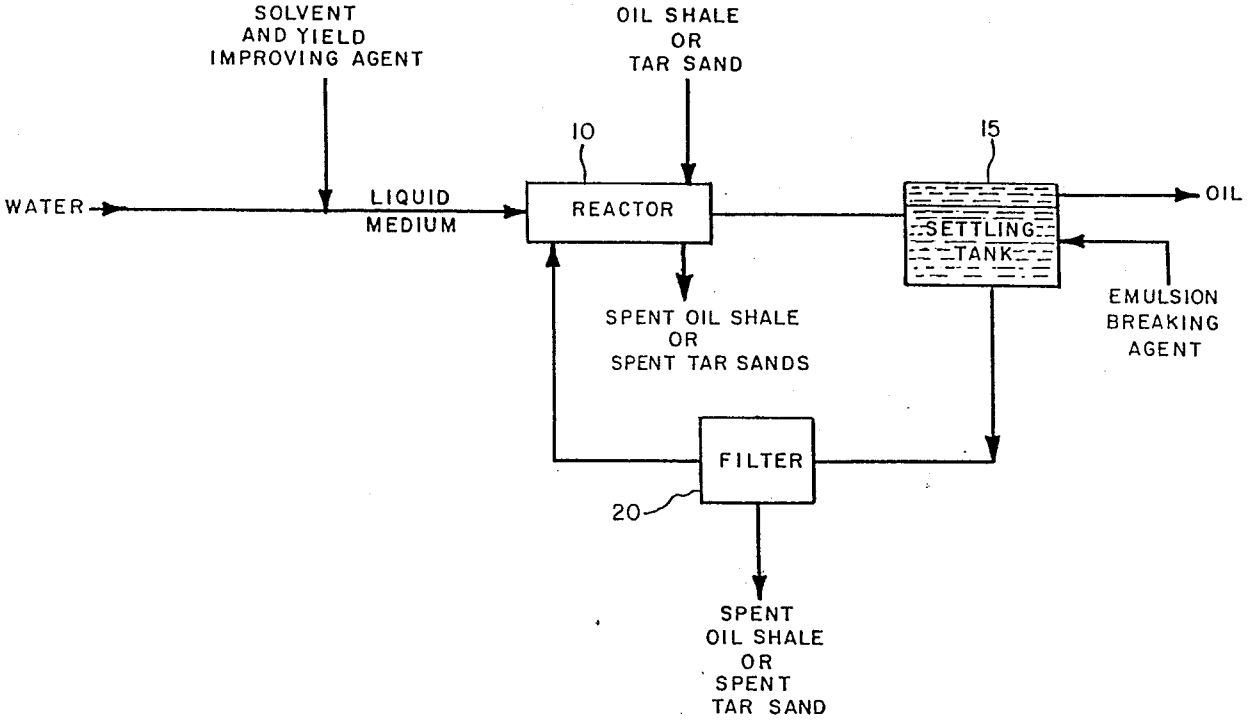
FIG. 1 depicts a schematic flow diagram of an embodiment of the process relating to the first two aspect of the present invention.

In accordance with the first two aspects of the present invention, it has been discovered that oil can be recovered from oil bearing soil, such as oil shale or tar sands, by contacting them with a heterogenous liquid medium. The medium comprises water and a lipophilic solvent which is miscible or soluble with water.

It is believed that upon contacting with the oil bearing soil, the heterogenous liquid medium disrupts the bonding within the kerogen-silicious system structure. As a result, oil is freed and attracted to the molecules of the medium. Since the medium contains water, the release of the oil into the medium creates an emulsion.

The inorganic portion of the oil bearing soil, dispersed throughout the emulsion, is separated by gravity or other suitable means. The emulsion is then contacted with an emulsion breaking agent which separates it into two phases. The two phases are allowed to separate from each other to form two layers. The first layer, comprising the oil and some medium, is separated and removed for shipment or further processing. The second layer, comprising the medium and some oil, can be recycled to the contacting zone.

The process and system of the first two aspects of the present invention offer numerous advantages over those of the prior art. One major advantage of the process and system is that they are inexpensive when compared with the prior art. The medium used in the process is inexpensive because its primary ingredient is water. Since the process can be operated at ambient temperatures and pressures, the required equipment is inexpensive. Therefore, the capital expenditures of the process are significantly lower than those of the prior art processes. The process is also inexpensive to operate as it requires minimal amounts of energy. Very little or no heat need be supplied to carry out the process and the only other energy is supplied to pump liquids and to effect mixing. The overall expense of the process is also comparatively lower than that of the prior art processes because the spent oil bearing soil does not need to be treated to support vegetation. Unlike spent oil bearing soil from many processes, the spent oil bearing soil of the process is generally close to neutral. As long as nutrients are added to the spent oil bearing soils resulting from the process, they will support vegetation. In fact, if the medium contains phosphorus, nitrogen, potassium or other nutrients required for plant growth, the spent oil bearing soils contain residual nutrients thereon.

Unexpectedly superior results are achieved by the process of the first two aspects of the present invention when the solvent is isopropyl alcohol and also when the liquid medium includes a yield improving agent in addition to the solvent and water. Particularly superior results are achieved when the solvent is isopropyl alcohol and the yield improving agent is an ionic salt such as ammonium sulfate, sodium chloride or sodium nitrate. Much superior and better results are also achieved when the solvent is n-butanol. Other higher alcohols including iso-butyl alcohols, amyl alcohols, and ethyl and methyl alcohol can be used.

Unexpectedly good results are achieved when the solvent in the medium is acetone and especially if a yield improving agent, comprising an ionic salt such as ammonium sulfate or sodium chloride, is included in the medium.

Also unexpectedly good results are achieved when the solvent is ethyl acetate and the yield improving agent is sulfuric acid.

GENERAL DESCRIPTION OF THE PROCESS OF THE FIRST TWO ASPECTS OF THE PRESENT INVENTION

The process of the first two aspects of the present invention will now be described in connection with the drawings. Referring now to the drawings, FIG. 1 depicts the schematic of a process for recovering oil from oil bearing soil carried out in accordance with the present invention. As shown in FIG. 1, water is first mixed with a lipophilic solvent and a yield improving agent to form a liquid medium. As explained above, the medium is a heterogenous liquid which includes water and a lipophilic solvent which is miscible or soluble in water. For best results the medium also includes a yield improving agent. The amount of the solvent should be sufficient to effect the desired recovery of oil but should be low enough to keep the cost of the raw materials used in the process at a minimum. The optimum amounts used depend on the particular process and materials; however, in general the amount of the solvent is in the range from about 10 to about 50 volume percent based on the volume of the solvent-water solution. The amount of a yield improving agent depends on economics. The cost of the additional agent must be weighed against the improvement of the yield or the reduced contact time to achieve the desired yield. Generally, if a salt is used as the yield improving agent, economics generally dictate the addition of the maximum amount of the salt so that the salt is added to saturate or nearly saturate the medium. The addition of the amount of the salt that brings the concentration thereof to or near the saturation point is highly desirable for yet another reason. Once the emulsion is formed, it can be broken by adding additional pure salt to the emulsion which contains enough salt to saturate the medium.

The medium is contacted with oil bearing soil, such as oil shale or tar sand, in a contacting zone of a reactor 10. The contacting is carried out at sufficiently high volume ratio of medium to oil bearing soil and for a sufficient time period to free from the oil bearing soil and bring into the emulsion a desired proportion of the oil contained in the soil. Generally, the ratio of medium to oil bearing soil is in the range from about 1/1 to about 100/1 and preferably in the range from about 2/1 to about 20/1. The shale (or tar sands) are preferably pulverized to achieve the optimum surface to volume ratio. The incremental cost of smaller sized shale or sand particles has to be balanced against the incremental increase of the yield of the process and shortened processing time.

Upon contacting, the medium disrupts the bonding within the oil-kerogen-silicious system structure and attracts the oil molecules. The oil molecules are freed from the soil and they enter the medium. Since the medium includes water a water-oil emulsion is formed. It is believed that the yield improving agent in the medium facilitates the disruption of the bonding in the soil and helps to attract the oil molecules to the medium.

The emulsion formed upon contacting has inorganic portions of the oil bearing soil dispersed throughout its volume. These portions are separated from the emulsion by gravity, filtration or other suitable means and the substantially particle-free emulsion is then passed to a settling tank 15 where it is contacted with an emulsion breaking agent.

The emulsion breaking agent causes the emulsion to break into two distinct phases which are allowed to separate into two layers. The first layer, which is generally the upper layer, comprises the oil and minor amounts of the medium. The second layer, which is generally the lower layer, comprises the medium and minor amounts of the oil. Both the first and the second layer may contain small amounts of inorganic portions of the oil bearing soil that have not been removed in the reactor 10.

The first layer is recovered and passed for shipment or for further processing. The second layer is passed through a filter 20 or another suitable means to remove any particulate inorganic portions which are present therein. The filtered part of the second layer is then recycled to the reactor 10 after adjusting the water-solvent salt concentration ratio (not shown).

THE MATERIALS USED IN THE PROCESS OF THE FIRST TWO ASPECTS OF THE PRESENT INVENTION

Starting Materials

The process of the first two aspects of the present invention can be performed on any type of oil bearing soil including oil shale, oil shale found in the Green River basin in the United States, and any type of tar sand, including those from Alberta, Canada.

The oil shale and tar sands for use in this process can be obtained from the deposits of any conventional method including those used to obtain shale and tar sands for retorting. The large size shale or tar sand is preferably comminuted in order to increase its surface to volume ratio and thereby expose more surface to the liquid medium. The optimum size of the particles is determined by balancing the costs of comminuting these materials against the increased profits due to improved yields and more rapid processing.

The Solvents

As explained above, the medium includes a solvent. The solvents suitable for the use in the medium are lipophilic solvents which are miscible with water including alcohols and ketones like acetone. Partially soluble ethyl acetate is also suitable. Unexpectedly good yields and processing times were obtained when using solvents such as, isopropyl alcohol, acetone, n-butanol and ethyl acetate. However, by far the best results were obtained using n-butanol and isopropyl alcohol. N-butanol gave better extraction results than isopropyl alcohol.

The Yield Improving Agents

The yield improving agents suitable for the use in the medium include water-soluble, ionic salts and water-soluble ionic acids. The preferred salt is ammonium sulfate but other salts such as sodium nitrate, potassium nitrate and sodium chloride can also be used. It is often desirable to have a sufficient amount of the salt in the medium to bring the concentration thereof to or near the saturation point.

The Emulsion Breaking Agent

It is preferred that the emulsion formed in the contacting step be broken by contacting it with a solid salt of the type utilized in the medium. If the medium is saturated or nearly saturated by such salt, the additional salt disrupts the emulsion causing it to separate into two distinct phases. Other emulsion breaking detergents or agents can also be used including Triton X100 and Tween 80.

The Product Of The Present Invention

The oil recovered by the process of the present invention is different in its composition than the oil recovered by retorting processes and conventional extraction processes because the kerogen is disrupted in a different manner than in these processes.

DESCRIPTION OF THE PREFERRED EMBODIMENTS OF THE FIRST TWO ASPECTS OF THE INVENTION

Figure 2:
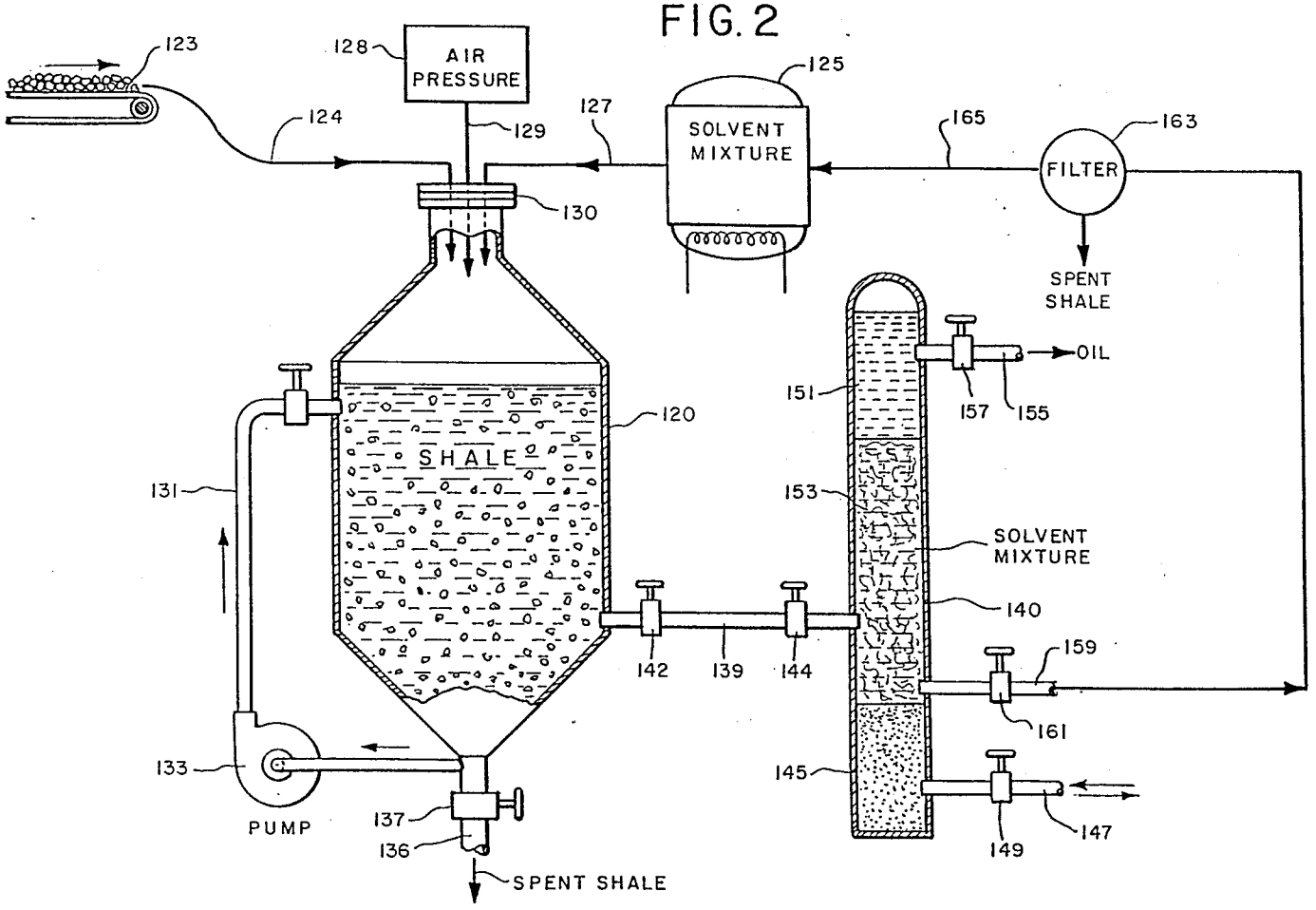
FIG. 2 depicts a flow diagram of the process and system of the preferred embodiments of the first two aspects of the present invention.

The first two aspects of the invention will now be described in connection with preferred embodiments depicted in FIG. 2. The preferred embodiments of the invention depicted in FIG. 2 are described in connection with a process for treating oil shale. It should be understood, however, that other oil bearing soils, such as tar sands and oil saturated sands, could be treated in the same manner by the process of the first two aspects of the present invention.

The First Preferred Embodiment

As shown in FIG. 2, oil shale is transported to a reactor 120 by a conveyer belt 123 or by other suitable means via a line 124. A premixed liquid medium stored in a tank 125 is introduced into the reactor 120 via a line 127. The medium comprises about 15 to 30 and preferably 17 to 25 percent by volume of water-isopropyl-alcohol solution of isopropyl alcohol, water and enough ammonium sulfate to bring it to or near a saturation point. Generally, that amount of ammonium sulfate is between about 7.5 grams per 100 milliliters of the solution to about 8.0 grams per 100 milliliters of the solution. The amount of ammonium sulfate depends upon the mineral contents of the water used. The solvent is introduced at a temperature of about 60°-80° C. in order to speed up the reaction and increase the yield.

The pressure in the reactor 120 is kept in the range from about 10 kg/cm$^2$ to about 70 kg/cm$^2$ in order to facilitate the extraction process. The pressure in the reactor 120 is maintained at desired levels by introducing therein air from a supply 128 via a line 129 through the gas seal 130.

In the reactor 120, oil shale and the medium are contacted together until a desired proportion of the oil is extracted from the oil shale. The contacting times can vary depending on the size of the equipment, specific type of shale and specific operating condition but it is the range from about ½ to about 6 hours and most often up to 4 hours. The agitation of the medium-oil shale mixture is provided by recycling it via a line 131 using a pump 133. The contacting produces an emulsion. The spent oil shale which is dispersed throughout the emulsion is allowed to settle to the bottom of the reactor 120 and it is removed therefrom via a line 136 by opening a valve 137.

The emulsion, which is substantially particle free, is then passed via a line 139 from the reactor 120 to a separation tank 140 by opening valves 142 and 144.

In the separation tank 140 the emulsion is contacted with a bed 145 of solid ammonium sulfate stored at the bottom of the tank 140. Ammonium sulfate is introduced and withdrawn from the tank 140 via a line 147 by opening a valve 149. As a result of the contacting under agitation, the emulsion breaks and separates into two distinct phases. The phases separate from each other forming two layers. The upper layer 151 contains the oil, minor amounts of inorganic portion of the oil shale (spent shale) and minor amounts of the medium. The lower layer 153 contains the medium, minor amounts of the oil and minor amounts of the inorganic portion of the shale (spent shale).

The upper layer is recovered via a line 155 by opening a valve 157 and passed to shipment or to further processing. The lower layer is passed via a line 159 through a valve 161 to a filter or a screen 163 to remove oil and shale particles therefrom.

The spent shale, removed from the filter or screen 163 and from the bottom of the reactor 120, is washed with water to recover therefrom isopropyl alcohol and ammonium sulfate adhering thereto. Isopropyl alcohol is recovered by distillation and the ammonium sulfate recovered by evaporation of water in open cement tanks exposed to solar heat or similar drying process. Residual ammonium sulfate left behind after water wash is sufficient to provide nutrition to vegetation that might be planted on the spent shale. The preferred system for recovering of the solvent and the yield improving agent from the spent shale is conventional in other solvent recovery systems and is not shown in the drawings.

The particle free medium is then passed via a line 165 to the tank 125.

The Second Preferred Embodiment

This embodiment is operated in the same manner and uses the same material and equipment as the first preferred embodiment depicted in FIG. 2 and described above, except that n-butanol was used as the solvent. The concentration of n-butanol was the same as that of isopropyl alcohol.

The yields in this embodiment were better than those in the first preferred embodiment.

The Third Preferred Embodiment

This embodiment is operated in the same manner and uses the same materials and equipment as the first preferred embodiment depicted in FIG. 2 and described above, except that acetone is used as the solvent in the liquid medium instead of isopropyl alcohol. The concentration of acetone is generally from about 5 to 30 volume percent by volume of acetone-water solution.

The yields of the third embodiment are less superior than those of the first embodiment.

The Fourth Preferred Embodiment

This embodiment is operated in the same manner and uses the same materials and equipment as the first preferred embodiment depicted in FIG. 2 and described above, except that the liquid medium and the emulsion breaking agent are different. The medium is formed as follows. A water solution containing about 5 to about 10 ml of sulfuric acid per 100 ml of the solution is first made. Enough ethyl acetate is then added to form a saturated ethyl acetate solution. Generally, 10 ml of ethyl acetate is needed per each 100 ml of the solution.

Upon contacting of the medium of the fourth preferred embodiment with oil shale, an emulsion similar to those of the first, second, and third preferred embodiments is formed. The emulsion is broken preferably by adding sodium chloride. Generally about 5 to 7.5 grams of sodium chloride needs to be added to each 100 g of the emulsion in order to break it.

EXAMPLE 1

One hundred grams of pulverized oil shale was reacted in a flask with 200 ml of a medium consisting of isopropyl alcohol, water and ammonium sulfate. The amount of isopropyl alcohol was 17.5 volume percent of the isopropyl alcohol-water solution. The quantity of ammonium sulfate was 8 grams percent, which saturated the medium with ammonium sulfate. The oil shale medium was agitated for about 45 minutes and heated in a water bath at 75°-80° C. Thereafter, the heat was removed and the mixture allowed to stand to separate and to allow the inorganic sediments (spent shale) to settle down. The liquid portion was decanted or filtered and transferred to a cylindrical container in which 25 grams of solid ammonium sulfate was placed at the bottom. Upon slight agitation the emulsion breaks causing the oil layer to separate out at the top. A small layer of sediments aggregated below the oil layer and was separated off by filtration. The remaining medium was filtered and reused for the next batch after adjusting the isopropyl alcohol concentration. The spent shale at the bottom was washed with 10 ml of water and then the mixture was filtered to recover the isopropyl alcohol and ammonium sulfate. The oil was examined and it showed the usual properties of a hydrocarbon mixture.

EXAMPLE 2

The procedures of Example 1 were repeated except that 10 grams of Bakersfield oil saturated sand was used instead of pulverized oil shale. The results were the same. The amount of oil initially recovered was 4.3 ml. The oil was golden brown in color. When the procedure was repeated on the same sand an additional 2.4 ml of oil was recovered.

EXAMPLES 3 and 4

The procedures of Examples 1 and 2 were repeated except ammonium sulfate was deleted from the medium. The emulsion was formed much slower and the amount of oil recovered was significantly less than in Examples 1 and 2.

EXAMPLE 5

Ten grams of Atabasca tar sand containing heavy tar-like material was contacted with the 20 ml of the medium of Example 1. The mixture was stirred with a spatula. After about 5-10 minutes the sand started to become pale gray and after about 15-20 minutes it was pale gray. The liquid above it had a color of a soap water. The tar separated and stuck to the spatula. Upon breaking of the emulsion in the manner described in Example 1, a clear transparent oil was formed. The amount of oil that was recovered was 2.2 ml. This example shows that the process not only removes oil from tar sand but also separates the tar from the oil. The procedure was repeated two more times using the same sand. An additional 1.6 and 0.9 ml of oil were recovered, respectively.

EXAMPLE 6

The same process as in Example 1 was used except 17.5% isopropyl alcohol was replaced by 20% acetone, the rest of the process including the addition of ammonium sulfate remained the same. The results were the same as in Example 1 except that it took longer to form the emulsion and less oil was recovered.

EXAMPLE 7

One hundred grams of powdered shale was reacted with 200 ml of a medium consisting of 5 volume percent of sulfuric acid and 10 volume percent of ethyl acetate in water. The mixture was well agitated. Upon agitation an emulsion was formed as in Example 1. Eighty grams of sodium chloride was added to break the emulsion to separate the oil. The separation proceeded in the same manner as in Example 1. The results were the same as in Example 1 except that it took longer to form the emulsion and less oil was recovered.

EXAMPLE 8

10 gms of tar sands was contacted with a saturated solution of n-butanol (butyl alcohol) in water. The concentration of n-butanol in the solution was about 12 volume percent.

Slightly more than 8 gms of ammonium sulfate was then added to the mixture. The mixture was then agitated. A black tar-like material separated from the sand, leaving grayish clear sand at the bottom of the container. Yellow, yellow orange to red colored oil droplets separated from the sand and floated toward the top. The mixture was then allowed to stand until it separated into two layers. The top layer was decanted into a separate container. The top layer was an emulsion which included oil and some solution.

The top layer has the oil part with some of the solvent and some water. The top layer was transferred to another container and there contacted with a bed of solid ammonium sulphate, with mild agitation. The emulsion broke resulting in a typical oily layer containing some solvent. In this example especially when no heat is employed, the amount of water in the top oily layer emulsion is minimal, thus indicating a better process than the other examples. The lower water content in the oily layer and faster breaking of the emulsion is of industrial significance in terms of faster separation process.

EXAMPLE 9

The procedure of Example 8 was followed except that a 15% solution of n-butanol was used. Upon addition of butanol to water there was a slight separation of butanol on top of water. The solution was shaken before contacting it with tar sand. Upon shaking, the solution turned turbid.

The results were better than in Example 8.

EXAMPLE 10

The procedure of Example 8 was followed except that a 17.5% solution of n-butanol was used. The slight separation of n-butanol was observed as in Example 1. The solution was shaken before contacting it with tar sand. Upon shaking, the solution turned turbid.

The results were better than in Example 9.

EXAMPLE 11

The top oil layer obtained in Examples 8, 9 and 10 after breaking of the emulsion by contacting with solid ammonium sulphate was then studied for its chemical content using a spectroscopic technique.

The oil extracted by the isopropyl alcohol-water-salt technique was found to contain smaller amounts of the oil and lighter fractions as compared to the n-butanol-water-salt system where extraction was more complete and better. In each instance the "oil" layer was subjected first to a spectroscopic study using Gas-Liquid Chromatography technique using several types of GLC columns.

It was found that the solvent in each case, namely isopopropyl alcohol in the first and n-butanol in the second separated out in the first phase and would hence be removed when this process is applied at larger industrial levels.

Subsequent to the solvent phase and quite clearly separated from it appeared the remaining materials that had been extracted out in the oil. Owing to the heterogenous nature of the materials extracted in the first Gas-Liquid Chromatography studies, one found distinct "manifolds" or groups of peaks of materials, with composition of molecules with one carbon to twenty-six carbons ($C_1$ to $C_{26}$), with a significant majority in the $C_{15}$ to $C_{22}$ range.

To determine whether the organic materials were hydrocarbons, the samples were subjected to a Mass Spectra analysis. The results confirmed that the hydrocarbons entracted were between those with 8 to 26 carbon atoms; the majority of the hydrocarbons being those with from 10 to 22 carbon atoms. The GLC-Mass Spectra analysis further showed that the hydrocarbon fractions include alkanes, cycloalkanes, alkenes and alkynes in the carbon number ranges cited above.

DETAILED DESCRIPTION OF THE THIRD ASPECT OF THE PRESENT INVENTION

Figure 3:
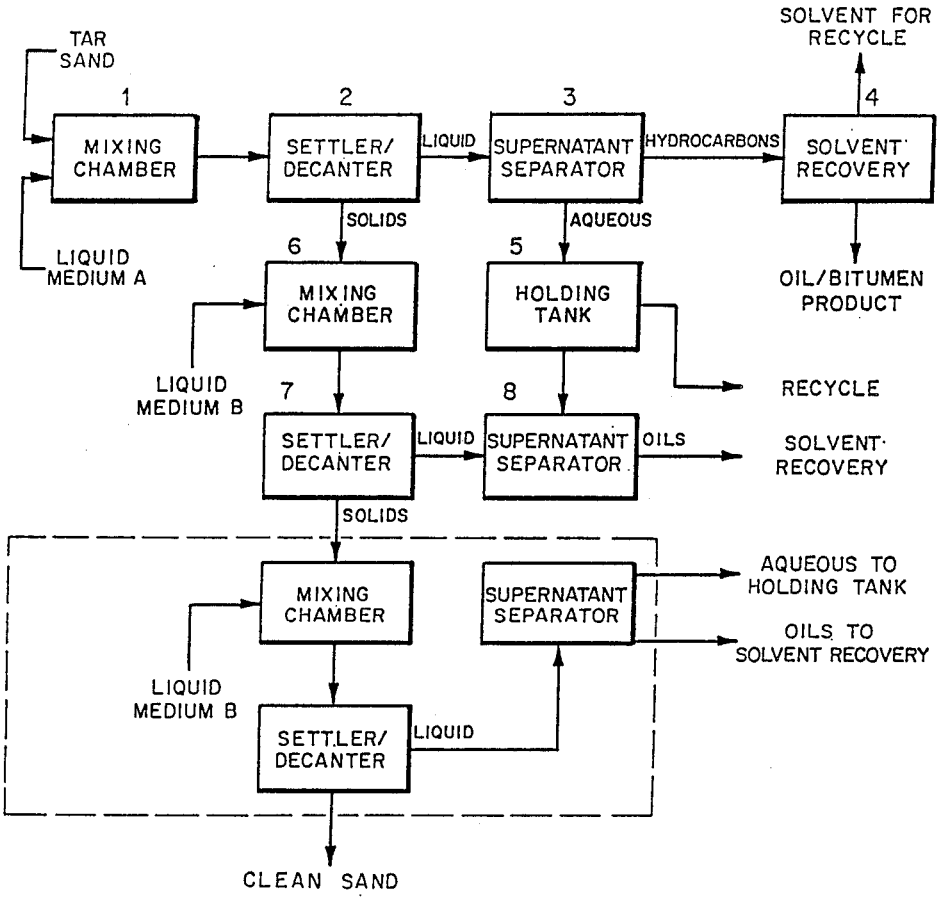
FIG. 3 depicts a flow diagram of the process and system of the preferred embodiment of the third aspect of the present invention.

FIG. 3 depicts a flow diagram for a preferred embodiment of the third aspect of the present invention. In this third aspect, tar sands are contracted in a first contacting zone (labeled mixing chamber 1 in FIG. 3) with a first liquid medium (labeled liquid medium A in FIG. 3). The first liquid medium comprises an intimately mixed phase emulsion of (1) a solvent which is not miscible or appreciably soluble with water, and (2) an aqueous solution of water, a surfactant and a non-caustic alkali compound.

After the tar sands and first liquid medium are mixed in the first contacting zone, the liquids and solids are separated. The liquids include the first liquid medium and a major portion of the originally present bitumen. The solids left over are sand and the remaining bitumen. The liquid is next separated in a supernatant separator into a hydrocarbon stream containing the solvent and the bitumen and an aqueous stream containing the water, surfactant and alkali compound. This aqueous stream may be fed to a holding tank and recycled. The hydrocarbon stream is separated, recovering and recycling the solvent and providing the bitumen product for further processing.

The solids removed from the first contacting zone are mixed with a second liquid medium (labeled liquid medium B in FIG. 3) in a second contacting zone (labeled mixing chamber 6 in FIG. 3). The second liquid medium comprises water, a surfactant and a non-caustic alkali compound. In the preferred embodiment, the second liquid medium is the same as the aqueous solution used in making the first liquid medium.

The solids removed from the second contacting zone contain sand and may still include small amounts of bitumen. If further recovery of this bitumen is desired, the processes associated with the dash line blocked portion of FIG. 3 may be repeated one or more times. The steps in the blocked portion of the flow diagram are identical to the contacting, mixing and separating steps associated with the second contacting zone, utilizing additional amounts of the second liquid medium. Prior to disposal, the sand resulting from the one or more mixings with the second liquid medium may optionally be washed with water to remove any traces of surfactants and alkali compounds remaining with the sand.

The liquid separated from the sand in the second contacting zone are subjected to the same treatments as the liquid removed from the first contacting zone. However, there is much less solvent associated with the bitumen in the liquid recovered from the second contacting zone as compared to the liquid from the first contacting zone since in the preferred embodiment, the second liquid medium contains no solvent.

Inasmuch as the aqueous portion of the first liquid medium has the same composition as the second liquid medium in the preferred embodiment, the material from the holding tank can be recycled to either the first or second contacting zone. Of course before being introduced into the first contacting zone, the recycled aqueous material must be mixed with solvent (either from recycle or from a make-up source) to produce an intimately mixed phase emulsion. The ratio of tar sand to the liquid medium in each contacting step is preferably between about 0.5 to about 2.0 liters of liquid medium per kilogram of tar sand. Most preferred is a ratio of about one liter of liquid medium per kilogram of tar sand. Mixing and settling times need to be sufficient for separating and recovering the bitumen. Actual times will depend on the equipment and size of the containers used.

The aqueous component of the first liquid medium and the second liquid medium of the preferred embodiment of the third aspect of the present invention comprise about 0.025% to about 0.5% surfactant, most preferably about 0.1%. A preferred surfactant is sodium lauryl sulphate. Other suitable surfactants include Tween-80 (polysorbate-80), sodium tetradecyl sulfate, diocyl calcium sulfosuccinate, sodium lauryl sulfoacetate and sodium lauryl sarcosinate.

The aqueous component of the first liquid medium and the second liquid medium also comprise about 0.1% to about 5.0% non-caustic alkali compounds, most preferably about 1.0%. A preferred alkali compound is sodium bicarbonate. Other suitable alkali compounds include sodium carbonate, potassium carbonate, potassium bicarbonate and ammonium carbonate.

The volume ratio of solvent to aqueous component in the first liquid medium should be between about 1:10 and about 4:6, most preferably about 1:4. The preferred solvent is light naphtha-50. However, other suitable solvents include commercial gasoline (unleaded), wellhead raw gasoline, kerosene, hexane, cyclohexane, pentane, cyclopentane, Stoddard's solvent, tetrachloroethylene, carbon tetrachloride, benzene, petroleum ether, toluene and xylene.

It is essential that the aqueous component and solvent be intimately mixed together into a phase emulsion before contacting the tar sands. It has been found that contacting the tar sands with the intimately mixed phase emulsion produces better results than treating the sands first with an equivalent amount of solvent followed by treatment with the aqueous component of the first liquid medium.

A good example of a phase emulsion is an oil and aqueous vinegar salad dressing. After being shaken up, the materials stay in a phase emulsion for a short time phase, but eventually separate into two layers. Likewise, in the present invention, the solvent and the aqueous component must be intimately mixed, then contacted with the tar sands before they separate into two layers.

It is speculated that the solvent acts as a "trigger," allowing the surfactant and alkali compound in the aqueous solution to begin extracting away the bitumen from the sand. However, the solvent in the relatively small quantities used herein is simply absorbed by the tar sands if the aqueous component is not present at the same time.

When the process of this third aspect of the present invention is carried out in a batch process, the container used for the first contacting zone can be used for each of the subsequent contacting zones, decanting off the liquid after each step and leaving the solids in the container. In such batch processes it has been found that three contacts with the second liquid medium is sufficient to produce a clean sand, recovering almost all of the bitumen.

As with the other aspects of the present invention, the process of this aspect produces a high yield from the tar sands at low temperature operation. In the preferred embodiment, the process is practiced at room temperature using cold tap water in the aqueous component of the liquid mediums. This process has been successfully practiced even using refrigerated water.

Various tar sands may successfully be utilized in the process of the third aspect of the present invention. Water-wet tar sands such as the Athabasca tar sands in Canada, oil-wet tar sands such as those in the United States, and even McKittrick diatomaceous tar sands, have successfully been processed in accordance with the third aspect of the present invention.

The following examples provide batch process illustrations of the third aspect of the present invention as it has been practiced on various tar sands.

EXAMPLE 12

Two kilograms of Athabasca tar sands containing approximately 12% bitumen were placed in an open container. A first liquid medium was prepared as follows: 0.1 grams of sodium lauryl sulfate and 1.0 gram of sodium bicarbonate per 100 ml. of aqueous solution were first dissolved in cold tap water. On a volume basis, 80% of the aqueous solution and 20% light naphtha-50 were poured into a bottle to provide two liters of first liquid medium. The bottle was approximately ⅔ full. The bottle was capped and vigorously shaken by hand for about two minutes. The liquid medium in the bottle was intimately mixed, forming a phase emulsion. The contents of the bottle were quickly poured into the container with the tar sands. A slow mechanical stirring device was used to stir the first liquid medium and tar sands for about ten minutes. Other than the use of cold tap water, all of the ingredients were used at room temperature. No heat was applied to the container.

The contents of the container were allowed to stand for about five minutes. Then the top layer of liquid, containing a major portion of the bitumen and naphtha, was decanted into a second container. Underneath the top layer was a layer of water with suspended sand particles. On the bottom of the container was a layer of sand.

Two liters of a second liquid medium comprising just the aqueous component of the first liquid medium (namely, 0.1 grams of sodium lauryl sulfate and 1.0 gram of sodium bicarbonate per 100 ml of solution) were next poured into the container. The slow mechanical stirrer was used to mix the contents of the container for about five minutes. After standing five minutes, the container was again decanted, pouring off the top layer of liquid into the second container already containing the bitumen from the first contacting operation.

Two liters of the second liquid medium were again added to the container and mixed for five minutes. After settling for five minutes, the liquid was decanted. This step was repeated again with another two liters of the second liquid medium, five minutes of mixing, five minutes of settling, and decanting.

Less and less bitumen was contained in each of the top layers from the successive mixings. Also, the middle layer of water with suspended particles was smaller and smaller each time, so that after the last mixing the liquid was decanted completely from the sand. The remaining sand was visibly white with a few small flecks of unextractable alsphaltines. Analysis of the sand indicated that 93% of the bitumen originally present had been removed.

The bitumen and naphtha formed a layer on top of the aqueous phase in the second container. The bitumen could be scooped out with a ladle. If left for several days, the naphtha would evaporate, leaving a soft pancake-like layer of bitumen.

EXAMPLE 13

One kilogram of Athabasca tar sand containing 8% bitumen by weight was placed in a container. A first liquid was prepared using the same ingredients as in the first liquid medium of Example 12, except that one liter of liquid medium was prepared using a volume ratio of 15% naphtha and 85% aqueous component. This first liquid medium was agitated as in Example 12 to form an intimately mixed phase emulsion, which was immediately added to the container with the tar sands. Thereafter, mixing, settling and decanting, as in Example 12, were carried out. Likewise, the second, third and fourth contacting with the second liquid medium of Example 12 was carried out, except only one liter of liquid medium (as compared to two liters in Example 12) were used each time. After the fourth contacting, the sand was visibly white and bitumen recovery appeared to be the same as in Example 12.

EXAMPLE 14

Oil-wet Kentucky tar sand was mechanically crushed to obtain a mixable tar sand material, one kilogram of which was placed in a container. One liter of the first liquid medium of Example 13 was intimately mixed then poured into the container. Mixing, settling and decanting were carried out as in Example 13, as were three subsequent mixing, settling and decanting steps using the second liquid medium of Example 13. After the fourth contacting, the sand was visibly white and bitumen recovery appeared to be the same as in Example 12.

EXAMPLE 15

The process of Example 13 was carried out using one kilogram of McKittrick diatomaceous tar sands. After the fourth contacting, the sand was visibly white and bitumen recovery appeared to be the same as in Example 12.

In industrial operatings, it would be most preferred to prepare the second liquid medium containing the surfactant and non-caustic alkali compound in quantity. The first liquid medium could then be intimately mixed from the required amounts of solvent and second liquid medium.

It is speculated that instead of using 10%–40% solvent in the first liquid medium and no solvent in the liquid medium used for the second and subsequent contactings, the solvent might be proportionately reduced and one common liquid medium used in each contacting. For example, instead of 20% solvent in the first liquid medium, tar sands could be successively contacted with four liquid mediums each containing 5% solvent intimately mixed with the aqueous component. However, at the present time, the process using solvent in only the first liquid medium is preferred, subject to further experimentation.

The examples have illustrated the process of the third aspect of the present invention using four contacting and separating steps. The necessity of the fourth step, and possibly the third step as well, may be eliminated with better mixing and separating equipment. The appropriate number of additional contacting steps after the first two (possibly even more than the two illustrated) is subject to the trade-off in additional cost versus diminishing recovery for each additional steps. At present, the preferred batch operation uses four contacting and decanting steps in total.

Many changes and modifications may occur to those skilled in the art upon studying this disclosure. All such changes and modifications that fall within the scope of the invention as defined by the appended claims are intended to be included within its scope.

We claim:

1. A process for recovering oil from oil bearing soil such as oil shale or tar sands, comprising:

(a) contacting said oil bearing soil with a liquid medium comprising water, ethyl acetate and sulfuric acid, to produce an emulsion comprising oil removed from said soil and said medium;

(b) breaking said emulsion;

(c) allowing the resulting two phases to separate into two layers, a first layer comprising said oil, minor amounts of the soil and minor amounts of said medium, a second layer comprising said medium, minor remainder of the soil and minor amounts of said oil;

(d) recovering said first layer.

2. The process of claim 1 wherein the amount of sulfuric acid is about 10 ml per 100 ml of sulfuric acid-water solution and the amount of ethyl acetate is sufficient to form a saturated or nearly saturated ethyl acetate solution.

3. A process for recovering bitumen from tar sand comprising the steps of:

(a) contacting tar sand in a first contacting zone with a first liquid medium comprising an intimately mixed, phase emulsion comprising (1) about 10 to about 40 volume percent of a solvent and (2) about 60 to about 90 volume percent of an aqueous solution comprising water, about 0.025 to about 0.5 weight percent of a surfactant and about 0.1 to about 5.0 weight percent of a non-caustic alkali compound;

(b) mixing said tar sand and said first liquid medium to release bitumen from the tar sand;

(c) separating the released bitumen and solvent from the mixture of step (b) from the remaining sand;

(d) contacting the remaining sand with a second liquid medium comprising an aqueous solution comprising water, about 0.025 to about 0.5 weight percent of a surfactant and about 0.1 to about 5.0 weight percent of a non-caustic alkali compound;

(e) mixing said remaining sand and said second liquid medium to further release bitumen from the sand and (f) recovering the further released bitumen from the mixture of step (e).

4. The process of claim 3 wherein steps (d), (e) and (f) are repeated one or more times.

5. The process of claim 3 wherein the solvent comprises naptha.

6. The process of claim 3 wherein the surfactant in steps (a) and (d) comprises sodium lauryl surfate.

7. The process of claim 3 wherein the non-caustic alkali compound comprises sodium bicarbonate.

8. The process of claim 3 wherein the volume ratio of solvent to aqueous solution in step (a) is about 1:4.

9. The process of claim 3 wherein the aqueous solution of step (a) and step (d) have the same compositions.

10. The process of claim 3 wherein the aqueous solution of step (a) and/or step (d) comprises water, about 0.1% surfactant and about 1% non-caustic alkali compound.

11. The process of claim 3 wherein the contacting and mixing of steps (a), (b), (d) and (e) are conducted at temperatures in the range of ambient temperatures.

* * * * *